US008753039B2

(12) United States Patent
Ytournel et al.

(10) Patent No.: US 8,753,039 B2
(45) Date of Patent: Jun. 17, 2014

(54) DEVICE FOR TRANSPORTING AND PLACING A BRIDGE OF AN OFFSHORE OIL RIG FOR SEA OPERATION ONTO A FLOATING OR STATIONARY STRUCTURE

(75) Inventors: Sophie Ytournel, Paris (FR); Thomas Coudray, Maurecourt (FR); Jean-Claude Naudin, Chelles (FR); Philippe Weber, Bourg-la-Reine (FR)

(73) Assignee: Technip France (FR)

( * ) Notice: Subject to any disclaimer, the term of this patent is extended or adjusted under 35 U.S.C. 154(b) by 487 days.

(21) Appl. No.: 13/133,769

(22) PCT Filed: Dec. 10, 2009

(86) PCT No.: PCT/FR2009/052472

§ 371 (c)(1),
(2), (4) Date: Sep. 22, 2011

(87) PCT Pub. No.: WO2010/067025

PCT Pub. Date: Jun. 17, 2010

(65) Prior Publication Data

US 2012/0000407 A1 Jan. 5, 2012

(30) Foreign Application Priority Data

Dec. 10, 2008 (FR) ..... 08 58433

(51) Int. Cl.

| | |
|---|---|
| ***E02B 17/04*** | (2006.01) |
| ***E02B 17/08*** | (2006.01) |
| ***B63B 35/00*** | (2006.01) |
| ***B63B 35/28*** | (2006.01) |

(52) U.S. Cl.

USPC ..... 405/203; 405/209; 114/26

(58) Field of Classification Search

CPC ..... E02B 17/00; E02B 17/04; E02B 17/06; E02B 17/08; E02B 17/0809; E02B 17/0818; E02B 17/0827; E02B 17/0836; E02B 2017/0039; E02B 2017/0043; E02B 2017/0047; E02B 2017/0052; E02B 17/024; B63B 1/10; B63B 1/12; B63B 1/121; B63B 1/14; B63B 9/065; B63B 35/38; B63B 35/44; B63B 35/4413; B63B 2001/12; B63B 2001/121; B63B 2001/123; B63B 2001/14; B63B 2009/067; B63B 35/003

USPC ..... 114/61.1, 264, 265, 26; 405/195.1, 405/203–209

See application file for complete search history.

(56) References Cited

U.S. PATENT DOCUMENTS

| | | | |
|---|---|---|---|
| 3,078,680 A | 2/1963 | Wepsala | |
| 3,259,371 A | 7/1966 | Goepfert et al. | |

(Continued)

FOREIGN PATENT DOCUMENTS

| | | | |
|---|---|---|---|
| GB | 2064628 A | 6/1981 | |
| GB | 2156286 A * | 10/1985 | ..... B63B 35/02 |

(Continued)

OTHER PUBLICATIONS

International Search Report dated May 27, 2010, issued in corresponding international application No. PCT/FR2009/052472.

*Primary Examiner* — Ajay Vasudeva
(74) *Attorney, Agent, or Firm* — Ostrolenk Faber LLP

(57) ABSTRACT

A device for transporting and placing a bridge (1) of an offshore oil rig onto a floating or stationary mounting structure (3). The device has two parallel floating barges (10) for mounting the bridge (1). Each barge has a set of vertical movement rams (11) that move the bridge between a position of bearing on the barges (10) and a position of bearing on the structure (3). Each barge (10) has at least one assembly (15) for controlling the roll of each barge (10) in relation to the bridge (1) during the placement of the bridge onto the mounting structure (3). The assembly includes at least two rams (16) that are carried by the barge (10) and are located on both sides of the longitudinal axis of the barge (10). Each ram (16) is connected to the bridge (1) by a connecting member (17) that has rigid pull and flexible compression.

8 Claims, 4 Drawing Sheets

(56) References Cited

U.S. PATENT DOCUMENTS

| | | | | | |
|---|---|---|---|---|---|
| 4,242,011 | A | * | 12/1980 | Karsan et al. | 405/204 |
| 4,556,004 | A | * | 12/1985 | Lamy et al. | 114/61.14 |
| 4,744,697 | A | * | 5/1988 | Coppens | 405/204 |
| 4,973,200 | A | * | 11/1990 | Kaldenbach | 405/205 |
| 5,607,260 | A | * | 3/1997 | Khachaturian | 405/204 |
| 5,662,434 | A | | 9/1997 | Khachaturian | |
| 5,829,919 | A | * | 11/1998 | Heerema | 405/209 |
| 6,171,028 | B1 | * | 1/2001 | Van Gelder | 405/209 |
| 6,364,574 | B1 | | 4/2002 | Khachaturian | |
| 6,367,399 | B1 | | 4/2002 | Khachaturian | |
| 6,857,821 | B2 | * | 2/2005 | Steenhuis et al. | 405/203 |

FOREIGN PATENT DOCUMENTS

| | | | | | |
|---|---|---|---|---|---|
| GB | 2165188 | A | * | 4/1986 | B63B 35/00 |
| GB | 2174743 | A | * | 11/1986 | E02B 17/00 |

* cited by examiner

DEVICE FOR TRANSPORTING AND PLACING A BRIDGE OF AN OFFSHORE OIL RIG FOR SEA OPERATION ONTO A FLOATING OR STATIONARY STRUCTURE

CROSS REFERENCE TO RELATED APPLICATIONS

The present application is a 35 U.S.C. §371 National Phase conversion of PCT/FR2009/052472, filed Dec. 10, 2009, which claims benefit of French Application No. 0858433, filed Dec. 10, 2008, the disclosure of which is incorporated herein by reference. The PCT International Application was published in the French language.

BACKGROUND OF THE INVENTION

The present invention relates to a device for transporting and placing a bridge of an offshore oil rig for sea operation onto a floating or stationary structure.

Generally, offshore oil rigs for sea operation comprise a bridge carrying operating equipment and living space. The bridge is supported by a stationary structure, such as tubular pillars or legs pushed into the marine soil or resting thereon with the help of shoes or on a floating structure, such as a column or assembly of columns, for example.

The transport and placement of this type of platform on the operation site can be done in several ways.

The first method consists of transporting the bridge using at least one barge and then, using a crane, lifting the bridge and placing it on the mounting structure.

The second method consists of bringing the floating platform assembly to the operation site and attaching the platform on the site. In case of a stationary structure formed by telescopic legs, the legs are lowered until they come into contact with the sea bottom, then, bearing on the legs, the bridge is hoisted above sea level up to an altitude that puts it out of reach of the highest waves.

The third transport and placement method consists first of attaching the stationary or floating structure to the operation site and conveying the bridge of the rig from the assembly worksite to the site using at least one transport barge and, when the dimensions of the bridge are large or when the mounting structure does not make it possible to position the barge, the transport is then done using two parallel floating transport barges.

The bridge of the platform is therefore placed on the two barges, which are distanced from each other, to allow these barges to pass on either side of the floating or stationary mounting structure in order to install the bridge there.

After towing the assembly formed by the barges and the bridge, from the assembly worksite to the operation site, the bridge is positioned vertically relative to the mounting structure and the load of the bridge is transferred from the barges onto said structure.

The transfer of the bridge from the barges onto the mounting structure can be done in two ways, depending on the manner in which the bridge is carried by the barges.

The bridge of the oil rig is either placed on shims positioned on each barge or placed on a set of rams positioned on each barge.

In the first case, the passage of the bridge from the barges towards the mounting structure is done by ballasting the barges or deballasting the support column in the case of a floating structure.

In the second case, the passage from the mounting structure is done by actuating the rams to lift the bridge relative to the barges and the assembly is positioned above the mounting structure, then the rams are actuated to lower the bridge again and transfer the load of the bridge onto the mounting structure.

However, the problem that arises during installation of the bridge using barges on a slightly bumpy sea, lies in the movement of said barges relative to the bridge when the bridge is transferred from said barges onto the mounting structure.

To resolve this problem, it is known to install, between each barge and the bridge, brackets before towing the bridge and in a calm zone, such as close to the dock of the bridge assembly worksite. These brackets make it possible to rigidify the connection between the bridge and the barges.

When the assembly is on the operation site and the bridge is positioned near the mounting structure, the brackets can be cut away or removed before lifting the load of the bridge from the barges to the mounting structure.

The brackets are removed before or during the transfer of the bridge load from the barges to the floating structure. But in that case, the barges are free to roll, which causes additional stresses on the supports of the barges carrying the bridge.

The invention aims to resolve these drawbacks.

SUMMARY OF THE INVENTION

The invention therefore relates to a device for transporting and placing a bridge of an offshore oil rig onto a floating or stationary structure, said device comprising two parallel floating barges for mounting the bridge, each barge having a set of vertical movement rams situated on the longitudinal axis of the barge and that move said bridge between a position of bearing on the barges and a position of bearing on the floating or stationary structure. Each barge comprises at least one assembly for monitoring the roll of each barge in relation to the bridge during the placement of said bridge onto the mounting structure, the assembly comprising at least two rams that are carried by the barge and located on both sides of the longitudinal axis of the barge (10), each ram (16) being connected to the bridge by a connecting member that has rigid pull and flexible compression.

According to other features of the invention:

each member has a first end connected to the bridge by a rigid element and a second end connected to the corresponding ram, the connecting member has a first end directly connected to the bridge and a second end connected to the corresponding ram, the connecting member is formed by a cable or a chain, the rigid element is formed by a rod or a bar, the ram is carried by the barge in a substantially horizontal or vertical position, each ram is hydraulic or pneumatic, and each barge includes at least one assembly on each of its longitudinal edges.

BRIEF DESCRIPTION OF THE DRAWINGS

The invention will be better understood upon reading the following description, provided as an example and done in reference to the appended drawings, in which.

DESCRIPTION OF A PREFERRED EMBODIMENT

Figure 1:
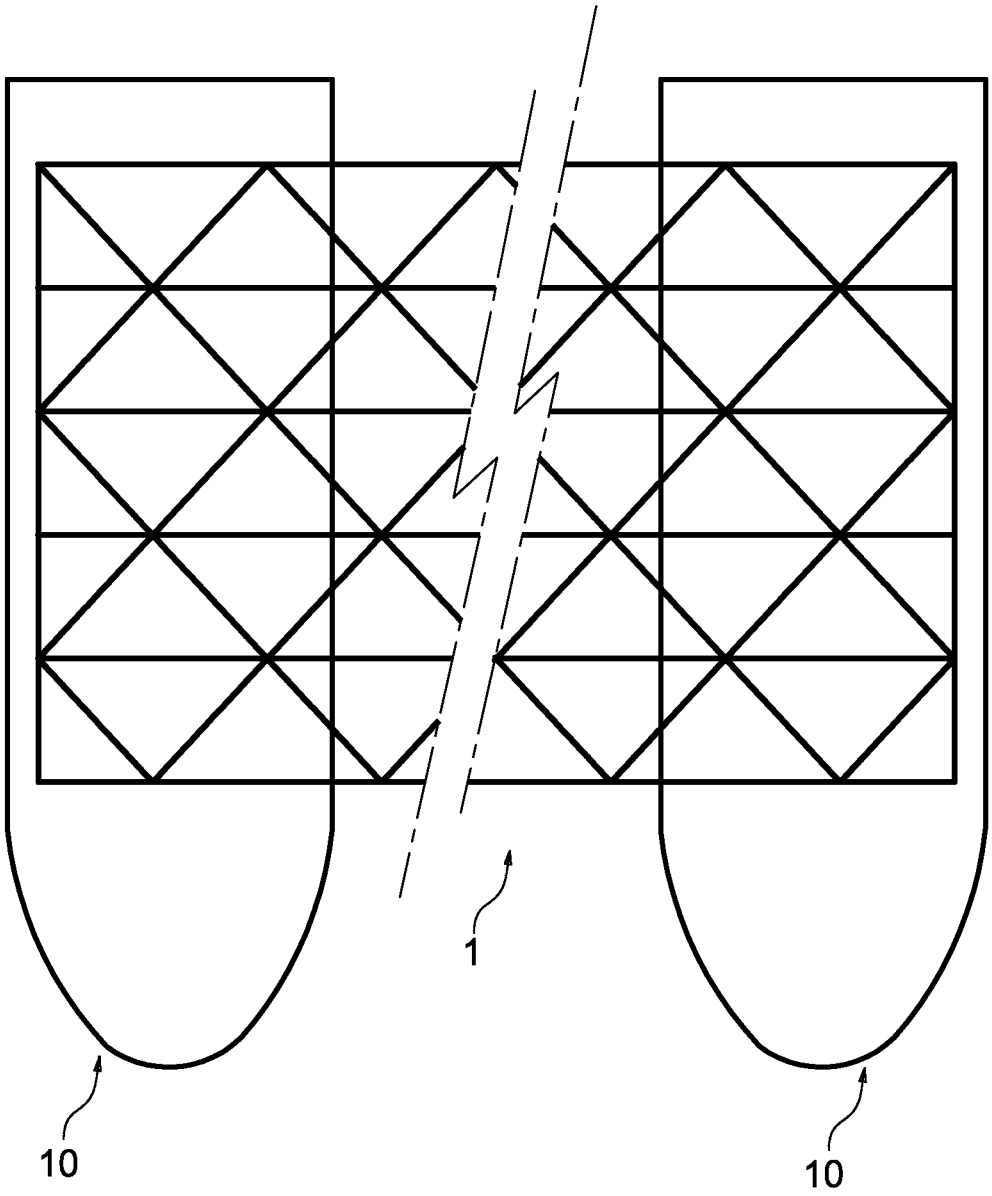
FIG. 1 is a diagrammatic top view of the device for transporting and placing a bridge of an oil rig, according to the invention.
Figure 2:
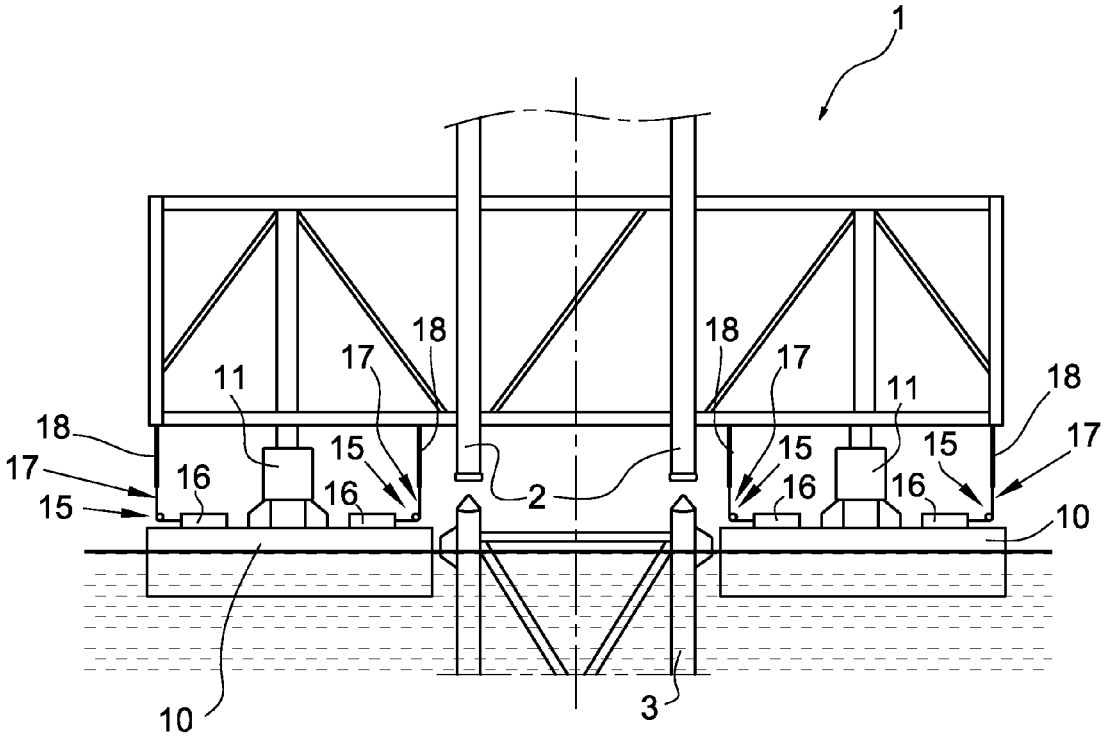
FIG. 2 is a diagrammatic side view of the transport and placement device, according to the invention.

FIGS. 1 and 2 diagrammatically show a device for transporting and placing a bridge 1 of an offshore oil rig for sea operation.

The bridge 1 is formed by an assembly of metal beams and includes, at its lower portion, positioning feet 2 for positioning on a floating or stationary mounting structure 3, of the known type.

The device for transporting and placing the bridge 1 comprises two floating parallel barges 10 separated from each other by a predetermined distance to make it possible to position the mounting structure 3 between the barges 10 so as to transfer the load of the bridge 1 from these two barges onto said mounting structure 3, as shown in FIG. 2.

The bridge 1 of the oil rig is therefore placed on the two barges 10 and after towing the assembly formed by the barges 10 and the bridge 1 from the assembly worksite to the operation site, this bridge 1 is positioned vertically relative to the mounting structure 3 and the load of the bridge is transferred from the barges 10 onto said mounting structure 3.

The transfer of the bridge from the barges 10 onto the mounting structure 3 can be done in two ways, depending on the manner in which the bridge 1 is supported by the barges 10.

In the embodiment shown in the figures and in particular FIG. 2, the bridge 1 is placed on a set of vertical movement lifting rams 11 arranged along and at the center of each barge 10, i.e. on the longitudinal axis of the barge 10.

In that case, the passage of the bridge 1 onto the mounting structure 3 is done by actuating the rams 11 to lift the bridge 1 relative to the barges 10 and the assembly is positioned above the mounting structure 3, then the rams 11 are actuated to lower the bridge 1 again and transfer the load of said bridge 1 onto the mounting structure 3.

To limit the movement of the barges 10 relative to the bridge during the placement of said bridge 1, in particular with a slightly bumpy sea, each barge 10 includes at least one assembly 15 for controlling the roll of each barge 10 relative to the bridge 1 when said bridge 1 is placed on the mounting structure 3.

Figure 3:
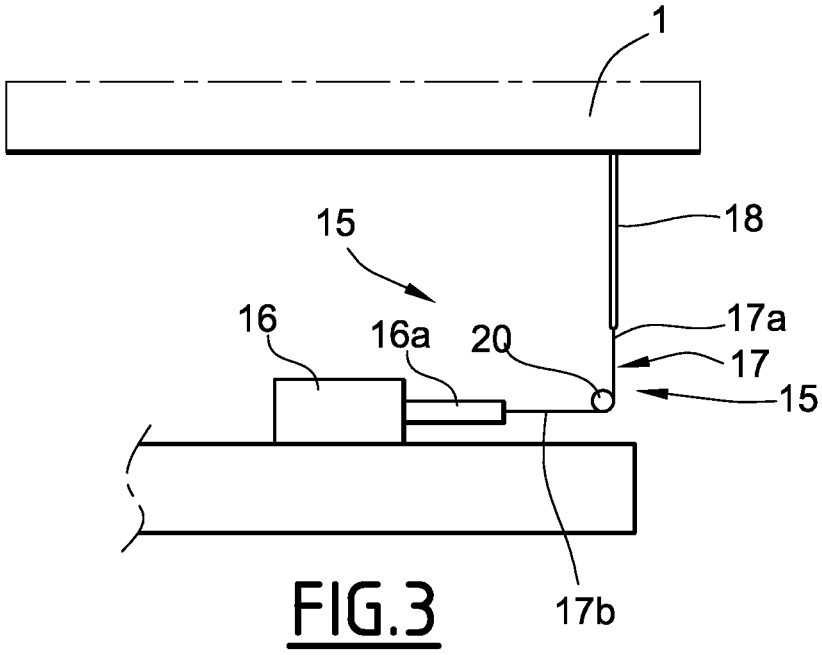
FIG. 3 is a diagrammatic side view on a larger scale of the means for prestressing and controlling the roll of a barge of the transport and placement device, according to the invention.

Said at least one assembly 15 comprises at least two rams 16 carried by the barge 10 and situated on either side of the longitudinal axis of the corresponding barge 10. Each ram 16 is connected to the bridge 1 by a connecting member 17 that has rigid pull and flexible compression as shown in FIG. 3.

According to the embodiment shown in the figures, the ram 16 is fastened on the bridge of the barge 10 in a substantially horizontal position and extends perpendicular to the longitudinal axis of said barge 10. The connecting member includes a first end 17*a* connected to the bridge 1 by a rigid element 18 and a second end 17*b* connected to the corresponding ram 16 by the piston rod 16*a*. The connecting member 17 goes around a return pulley 20.

According to one alternative, the connecting member 17 includes a first end 17*a* directly connected to the bridge 1 and a second end 17*b* connected to the corresponding ram 16 by the piston rod 16*a*.

According to another embodiment not shown, the ram 16 is fastened on the bridge of the barge 10 in a substantially vertical position.

The rigid element 18 is formed by a rod or a bar and the connecting member 17 is formed by a cable or a chain or any other suitable element.

The ram 16 is preferably hydraulic and can also be pneumatic.

Figure 4:
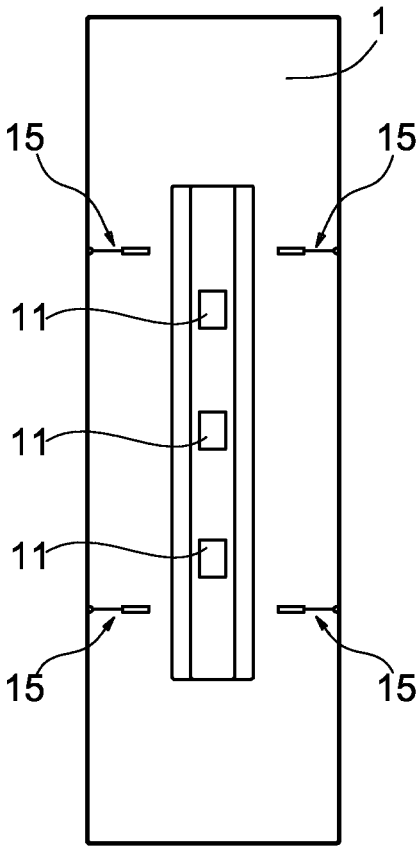
FIG. 4 is a top view of a barge according to the transport and placement inventive device.
Figure 5:
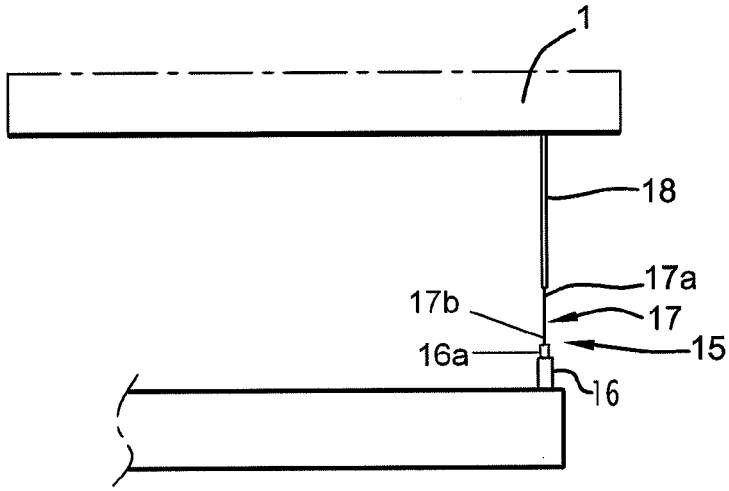
FIG. 5 is a diagrammatic side view on a larger scale of the means for prestressing and controlling the roll of a barge of the transport and placement device, the means being carried by the barge in a substantially vertical position, according to the invention.

As shown in FIG. 4, each barge 10 has at least one assembly 15 on each of its longitudinal edges, and preferably two assemblies 15 on each of its longitudinal edges so as to connect each barge 10 to the bridge 1 by four points.

The assemblies 15 ensure the limitation and control of the roll of each barge 10 individually relative to the bridge 1 to be installed during its placement on the stationary structure 3.

When the barges 10 carrying the bridge 1 reach the installation site, said at least one lifting ram 11 is actuated to lift the bridge 1 by a determined height relative to its initial towing position on the barges 10. The rams 16 are kept under pressure and as the bridge 1 is lifted, these rams 16 control and limit the roll of each barge 10 relative to the bridge 1.

Once the bridge 1 is placed on the mounting structure 3, the pressure in the rams 16 is released and each piston rod is free to move in the ram.

If the barges 10 rise under the effect of the swell or a wave, this movement is not transmitted to the bridge 1 due to the presence of the connecting member 17 between the cylinder rod 16*a* of the ram 16 and the bridge 1, which prevents said bridge 1 from rising from the mounting structure 3.

The device according to the invention therefore makes it possible, using simple means commonly used in this field, to control and limit the roll of each barge individually relative to the bridge during its installation on a floating or stationary mounting structure.

This device can also be used to control the roll of the barges when the bridge is transported between the assembly worksite of said bridge and the operation site.

What is claimed is:

1. A device for transporting and placing a bridge of an offshore oil rig onto a floating or stationary structure, said device comprising two parallel floating barges for mounting the bridge, each barge having a set of vertical movement rams situated on a longitudinal axis of the barge and that move said bridge between a position of bearing on the barges and a position of bearing on the floating or stationary structure, each barge comprising at least one assembly for controlling the roll of each barge in relation to the bridge during the placement of said bridge onto the structure, the assembly comprising at least two second rams that are carried by the barge and located on both sides of the longitudinal axis of the barge, each second ram being connected to the bridge by a connecting member that has rigid pull and flexible compression.

2. The device according to claim 1, wherein each connecting member has a first end connected to the bridge by a rigid element and a second end connected to the corresponding second ram.

3. The device according to claim 2, wherein the rigid element is formed by a rod or a bar.

4. The device according to claim 1, wherein each connecting member has a first end directly connected to the bridge and a second end connected to the corresponding second ram.

5. The device according to claim 1, wherein each connecting member is formed by a cable or a chain.

6. The device according to claim 1, wherein each second ram is carried by the respective barge in a substantially horizontal or vertical position.

7. The device according to claim 1, wherein each second ram is hydraulic or pneumatic.

8. The device according to claim 1, wherein each barge includes at least one of the assemblies on each of its longitudinal edges.

* * * * *